US008110076B2

(12) United States Patent
Ettel

(10) Patent No.: US 8,110,076 B2
(45) Date of Patent: Feb. 7, 2012

(54) APPARATUS AND FOAM ELECTROPLATING PROCESS

(75) Inventor: Victor Ettel, Toronto (CA)

(73) Assignee: Inco Limited, Ontario (CA)

( * ) Notice: Subject to any disclaimer, the term of this patent is extended or adjusted under 35 U.S.C. 154(b) by 1329 days.

(21) Appl. No.: 11/407,655

(22) Filed: Jun. 5, 2006

(65) Prior Publication Data

US 2007/0278105 A1 Dec. 6, 2007

(51) Int. Cl.
*C25D 7/06* (2006.01)
*C25D 17/00* (2006.01)

(52) U.S. Cl. ..... 204/206; 205/137; 205/138; 205/272

(58) Field of Classification Search ..... 204/280, 204/284; 205/272, 137
See application file for complete search history.

(56) References Cited

U.S. PATENT DOCUMENTS

| | | | | |
|---|---|---|---|---|
| 3,227,635 | A * | 1/1966 | Leland et al. | 205/138 |
| 3,821,097 | A | 6/1974 | Ettel | 204/106 |
| 4,310,403 | A * | 1/1982 | Nitto et al. | 204/206 |
| 4,326,931 | A * | 4/1982 | Kamijo et al. | 205/138 |
| 4,551,210 | A * | 11/1985 | Parthasarathi | 205/50 |
| 4,609,449 | A * | 9/1986 | Morin | 204/206 |
| 4,978,431 | A * | 12/1990 | Brannan et al. | 205/137 |
| 5,804,053 | A * | 9/1998 | Vaccaro et al. | 205/138 |
| 6,149,781 | A | 11/2000 | Forand | 204/239 |
| 6,190,530 | B1 * | 2/2001 | Brodsky et al. | 205/147 |
| 6,942,781 | B2 * | 9/2005 | Kuhn et al. | 205/138 |
| 2003/0188965 | A1 * | 10/2003 | King et al. | 204/198 |

FOREIGN PATENT DOCUMENTS

WO 03023091 3/2003

OTHER PUBLICATIONS

D.L. Wang et al., "Multiple-step constant current density electrodeposition of continuous metal material with high porosity", Journal of Applied Electrochemistry 33: p. 725-732, 2003.

* cited by examiner

*Primary Examiner* — Harry D Wilkins, III
*Assistant Examiner* — Bryan D. Ripa
(74) *Attorney, Agent, or Firm* — Arent Fox, LLP

(57) ABSTRACT

An improved apparatus and method of producing metal foam is provided which involves optimizing the natural convection of electrolyte through a foam being electroplated by inclining the foam during plating. A diagonal flow of electrolyte though the foam enhances electrolyte turnover within the foam while increasing electroplating efficiency. Further increases in plating efficiency are provided by shifting current density from higher plating zones to lower plating zones.

17 Claims, 6 Drawing Sheets

APPARATUS AND FOAM ELECTROPLATING PROCESS

TECHNICAL FIELD

The present invention relates to metal plated foams in general and to apparatus and methods for manufacturing them in particular.

DESCRIPTION OF RELATED ART

Metal foams, such as nickel foam, are well-known and used, for example, in making electrodes for batteries. Metal foam is a highly porous, open cell, metallic structure based on the structure of open-cell polymer foams. Metal foam may be produced by electroplating. To produce a metal foam such as nickel foam, nickel metal may be coated onto open-cell polymer substrates such as polyurethane foam and sintered afterwards to remove the polymer substrate in a controlled atmosphere at high temperature. A typical process can start with long strips of polyurethane foam, for example, between about 1-2 mm thick and about 1 m wide. The polyurethane strip can be made electrically conductive by coating, e.g., with a conductive carbon ink, by pre-plating with nickel using an electroless deposition, or by a vacuum sputtering process. Next, a thick layer of nickel is electrodeposited over the conductive layer to give between about 400 and 600 g/m2 of sheet. The electrically conductive foam is electrically plated by installing such foam as a cathode. The anode(s) is placed either at one or both sides of the foam strip. Metal foam may also be produced by carbonyl deposition which doesn't require pre-plating. Finally the foam may be heat-treated, e.g., at about 1000° C., to decompose and evaporate the polyurethane core and to anneal the nickel. A simple known continuous vertical plater is schematically depicted in FIG. 1 and more fully described below.

The metal deposition stage is critical and ultimately responsible for the quality of the foam product. It determines whether the foam density is sufficiently uniform along the surface and across the thickness. It determines if the physical properties of the metal, such as strength and elongation, are adequate and whether the chemical composition of the deposited metal is satisfactory and not contaminated by unwanted materials, e.g., in the case of deposited nickel, that it is not contaminated by copper, sulphur or other elements, which could negatively affect battery performance. Uniform electrodeposition is made difficult by the three-dimensional character of the foam and the nature of electrodeposition which can inhibit plating inside the structure. This is because the plating process inside the foam may be limited by the rate of the mass transport controlled by slow diffusion of metal ions into the inside structure of the foam. If the current density and total plating rate is too high relative to the rate of the diffusion process, the electrolyte inside the foam structure becomes depleted. Metal deposition then becomes inefficient, and the deposit porous and of poor quality. The resulting product is less plated in the middle than on the outside and has inferior mechanical and corrosion characteristics. Deposit or differential thickness ratio (DTR) is the ratio of the amount of outermost plating deposit to the amount of innermost plating deposit. It is difficult, for the reasons mentioned above, to obtain a DTR of 1:1.

Electrodeposition of any metal on the electrode surface must be supported by the effective transport of metal ions from the bulk of the solution to the electrode surface. In the body of the electrolyte, this transport is provided by electrolyte movement induced by density gradients (natural convection), or by mixing (forced convection). Electrolyte adjacent to the electrode surface is static however. Metal ions move to the surface by a diffusion process driven by concentration gradient between the bulk of electrolyte and the depleted electrolyte adjacent to the surface. Increasing current density increases the concentration gradient and reduces the surface concentration up to a point where it becomes zero. At that point, hydrogen ion discharge becomes prevalent, lowering the current efficiency of metal deposition. Metal deposited near or at this so-called limiting current may be of extremely poor quality, i.e., very porous and with entrapped electrolyte.

The depleted electrolyte within the diffusion layer is less dense and a buoyancy force makes it rise along a vertical electrode surface. This so-called natural convection flow helps supply metal ions to the outside of the diffusion layer and also limits its thickness, which is generally a fraction of one millimeter. Natural convection limits the useable current density and plating rate in most non-agitated systems to between about 200 and 1000 A/m$^2$, depending on deposit thickness and required product quality. In mechanically-agitated electrolyte systems, the diffusion layer thickness can be much lower, thus permitting faster plating. Unfortunately, mechanical agitation is not as uniform as natural convection so the deposition rate becomes less uniform as well.

Plating a three-dimensional structure such as foam is further complicated by electrolyte depletion inside the foam, where natural convection flow is severely inhibited. The pores inside the foam are a fraction of a millimeter across—comparable to the diffusion layer thickness—making the convective exchange of the depleted electrolyte with the bulk electrolyte extremely poor. In the case of a vertically oriented foam strip, depleted electrolyte inside the foam has lower density and creates a slow, laminar flow upwards inside the foam strip. It is replenished by a slow diffusion and very limited convective exchange with the bulk electrolyte as shown schematically in FIG. 2. Low electrolyte concentration inside the foam reduces electrochemical efficiency of plating and aggravates the non-uniform deposit thickness. Electrolyte motion and currents are depicted as arrows E. A mass transfer graph indicates relative flow velocity and nickel concentration both outside and within the foam F.

The depleted electrolyte inside the foam can be replenished by forced convection, e.g., by forcing electrolyte flow through the foam. However, this method can be difficult to control. Forced flow produced by pumping or agitation is typically not sufficiently uniform over the whole surface and also tends to distort the shape (flatness) of the plated area. Densities of foam will then reflect the local flow velocities and distances from the anode, becoming non-uniform over the surface. In most battery applications, non-uniform foam density is unacceptable as it causes premature battery failure in battery packs. Because of the difficulties with non-uniform plating under forced convection conditions, metal foam is frequently produced under natural convection. This provides more uniform plating rates, but also limits the current densities and plating rates to between 10 and 30 g/m$^2$/min, depending on the quality required.

Electrolytic platers used commercially for production of metal foam typically use either vertical or generally horizontal foam orientation. Platers with a vertical foam strip are relatively simple and the easiest to maintain, allowing for the highest productivity based on floor area. In a typical plater, the foam being plated moves upwards between baskets filled with plating nickel, while the electrical current is supplied to the plated foam by suitable contacts above the solution. FIG. 1 schematically illustrates a simple continuous vertical plater apparatus 1 for plating a continuous conductive foam strip 2 including a first vertically oriented anode 3 and a second vertically oriented anode 4. The strip 2 is fed around a feed roll 5 into an electroplating tank 6. The tank 6 is maintained with a suitable electroplating bath 7. The strip of conductive foam 2 is directed into the bath 7 downward and makes a turn around a lower immersed idler roll 8. The strip 2 then travels upward from the idler roll 8 out of the tank 6 to a metal cathode pinch-roller assembly 9, connected to a power supply, e.g., by means of a conventional slip ring (not shown).

Vertical plater geometry provides short distance between the contacts and the plated area—an important factor considering that all plating energy has to be supplied via the plated foam, and that foam conductivity is limited even at full product density leaving the plater. Unfortunately, vertical foam orientation does not provide effective natural convection into the foam, and this can lead to poor density distribution throughout the foam thickness.

Horizontal platers are known that have short non-horizontal sections to bring the foam in and out of the electrolyte and to supply the plating energy by contacts placed above the electrolyte. Such systems are inherently more complex, involve poorly accessible nickel baskets beneath the foam, and are generally more difficult to operate and maintain. Although horizontal platers provide more effective natural convection in the horizontal section, the productivity per unit of plant area may actually be lower than with vertical platers.

To maximize production, platers are usually operated at the highest current density (and productivity), allowable by the quality requirement of a particular application. However, electrolytic foam technologies share a common problem, i.e., inability to operate at a uniform current density matching the capability of mass transport. Convective mass transport is reasonably uniform along the foam being plated in vertical or horizontal platers, while the current density ranges from very high near the exit of plated foam (nearest to the current supplying contacts) to very low current density near the beginning of the plating zone, where foam density and conductivity is low. As a consequence, foam quality can be negatively affected by exceeding safe current density in the top zone, while most of the plater operates far below its productivity potential.

Accordingly, various electrolytic foam technologies involve the same compromise between productivity and quality. Foams with good density distribution across the thickness (DTR close to 1.0) can be produced only at fairly low production rates to avoid exceeding the critical current density in the end of the plating zone.

SUMMARY

An apparatus for electroplating foam is provided which includes a container, an anode and a cathode, wherein the anode and the cathode are located within the container, the anode including at least one metal for plating the cathode, the cathode including a polymeric foam including an electrically conductive material, wherein the cathode is oriented at an angle of about 1 degree to about 45 degrees relative to vertical. The cathode may be a continuous foam strip which is fed into the container, routed past the anode and out of the container by one or more guides. In the presence of a solution containing an electrolyte, the angle of the cathode causes a diagonal convection current of the solution through the foam, thereby increasing mass transport of electrolyte into the interior of the foam. In one embodiment, the anode is in a substantially vertical orientation within the container. In another embodiment, the anode is canted. In one embodiment, there are first and second anodes and the foam is positioned between the first and second anodes. In one embodiment, the anodes and cathode have respective ends where electrical current is applied, and the distance between the cathode and at least one of the anodes is greater at the ends where electrical current is applied than at opposite ends where current is not applied. In one embodiment, the anode and cathode have respective ends where electrical current is applied, and a porous non-conducting current limiting mask is positioned between the anode and the cathode for reducing current density between the anode and the cathode.

A method of electroplating foam is provided which includes providing a container, an anode, a polymeric foam cathode which includes an electrically conductive material, and a solution containing an electrolyte, wherein the cathode is located within the container such that upon application of electrical current to the anode and the cathode, the orientation of the cathode causes a diagonal convection route of the electrolyte through the foam; and applying electrical current to the anode and the cathode to electroplate the foam. In one embodiment, the anode is oriented substantially vertically and the cathode is oriented at an angle of about 1 degree to about 45 degrees relative to vertical. In another aspect, the method may further include controlling the current density between one or more anodes and the cathode to redistribute current density from the top of the plating zone to areas below.

DETAILED DESCRIPTION OF PREFERRED EMBODIMENTS

Optimization of natural convection through the interstices of a foam matrix results in a more efficient electroplating process and a metal foam having more uniform deposition of metal throughout its structure. Accordingly, the techniques disclosed herein advantageously allow increased strength of the finished material, as well as more uniform surface and interior structure, increased tensile strength, dimensional stability, wear resistance, and corrosion resistance.

Figure 2:
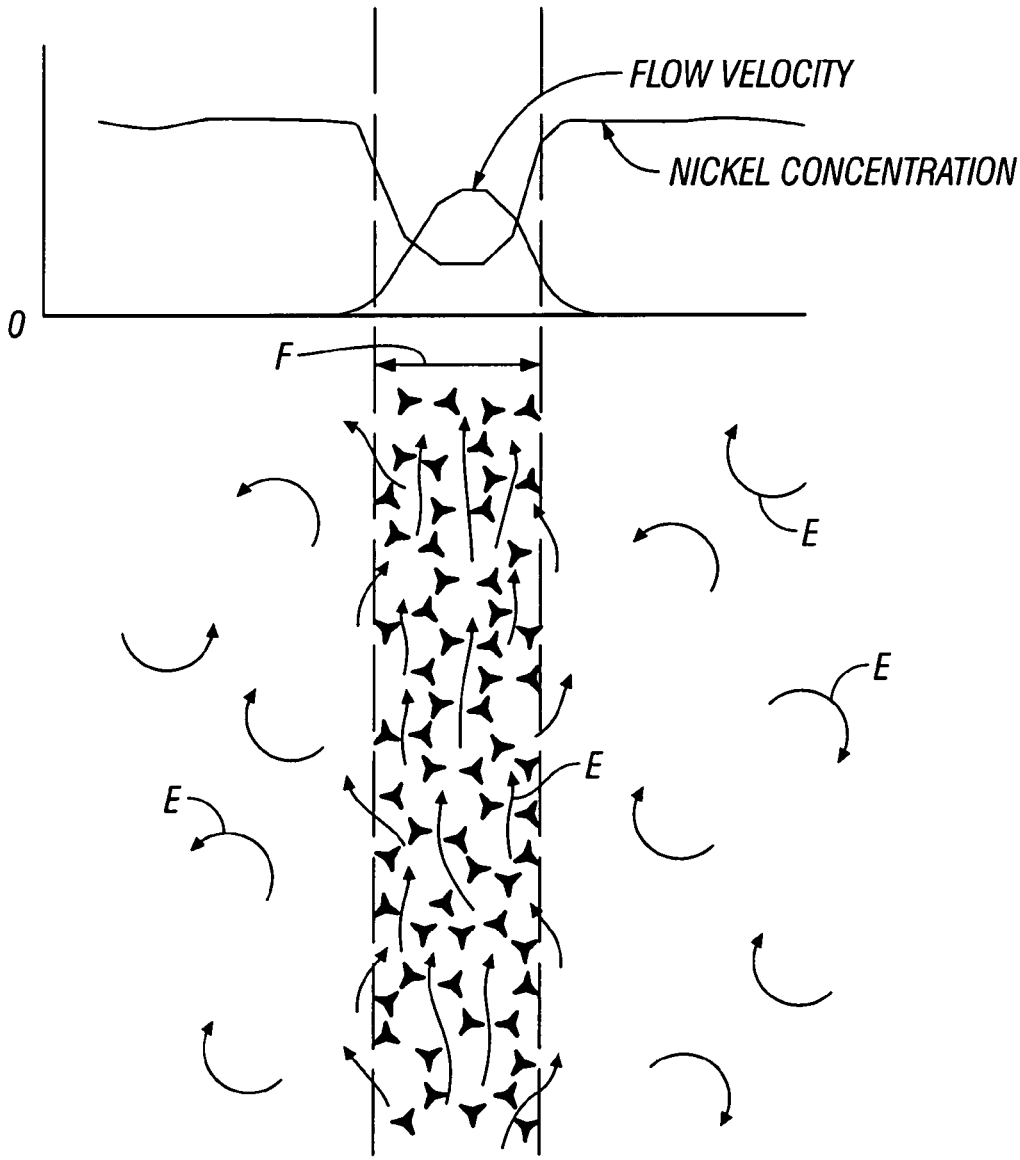
FIG. 2 (Prior Art)
FIG. 2 is a schematic depiction of the flow of electrolyte in and around a vertically oriented foam strip in accordance with the prior art. A mass transfer graph indicates relative flow velocity and nickel concentration inside and outside of the foam.
Figure 3:
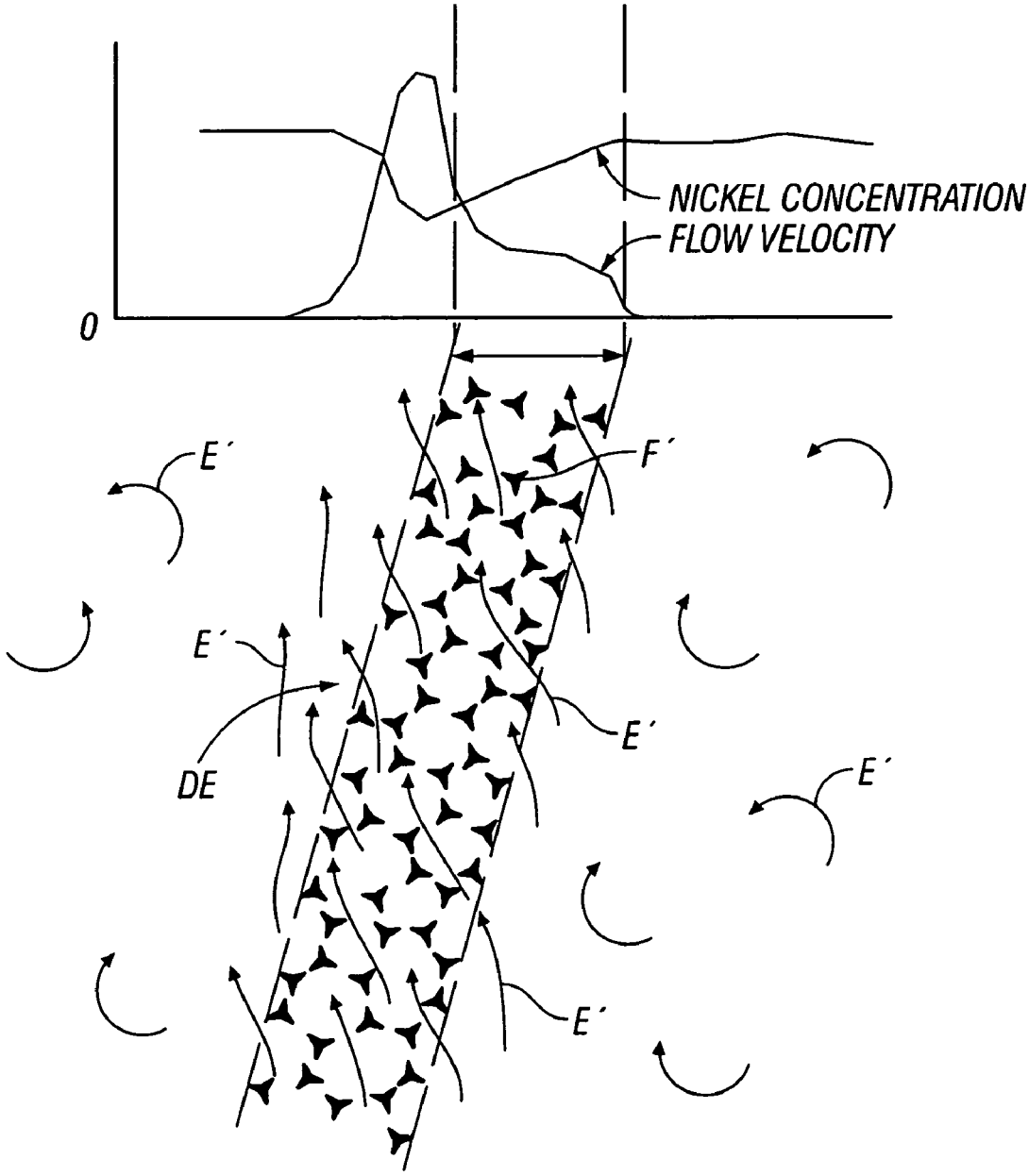
FIG. 3 is a schematic depiction of the flow of electrolyte in and around an inclined foam strip. A mass transfer graph indicates relative flow velocity and nickel concentration inside and outside of the foam.

Natural convection of electrolyte solution through the interstices of a foam matrix is optimized during electroplating by inclining or tilting the foam cathode in a plater. FIG. 3 schematically illustrates laminar flow of electrolyte through an inclined foam cathode F'. Electrolyte motion and currents are depicted as arrows E'. As electrolyte solution contacts the cathode F', as can be seen from the mass transfer graph, electrolyte is depleted in the area closest to the foam F', leading to a zone of lower density. The depleted, lower density electrolyte establishes a diagonal flow up across the foam F' and then upwards along the upper foam surface, while new, concentrated electrolyte is introduced from beneath the foam. In contrast to vertically oriented foam F where depleted electrolyte remains inside the foam and has a slow, laminar flow upwards inside the foam strip (see, e.g., FIG. 2), the depleted electrolyte has a lower dwell time in the foam F' since it more readily exits the opposing side of the foam, thus establishing a laminar flow zone of depleted electrolyte DE above the upper surface of the foam F'. In this manner, the electrolyte is replenished within the foam more efficiently. Moreover, rapid transport of the electrolyte through the foam F' minimizes the diffusion layer thickness. Accordingly, the techniques disclosed herein provide improved plating conditions inside the foam F', improved product quality and faster plating. Since there is no mechanical agitation needed to achieve these effects, a more uniform deposition rate is provided.

The angle required for inducing net flow across the thickness of the foam may range from about 1 to about 45 degrees, e.g., from about 2 to about 30 degrees and preferably ranges between about 10 to about 20 degrees. The angle is advantageously closer to vertical since the depleted, lower density electrolyte solution forms a more laminar flow upwards, creating a better pressure differential and flow rate across the foam than a more horizontal angle, which leads to a more turbulent flow of the depleted electrolyte. Turbulent flow results in more rapid mixing and dissipation of the low-density electrolyte emerging from a more horizontally positioned foam (e.g., greater than about 45 degrees) and actually results in diminished driving force for the flow across the foam compared to an electrode positioned closer to vertical. Other advantages of the present invention are that the simplicity and serviceability of a vertical plater are retained compared to a horizontal plater and productivity per unit of plant area is better than either a vertical or a horizontal plating apparatus.

Figure 1:
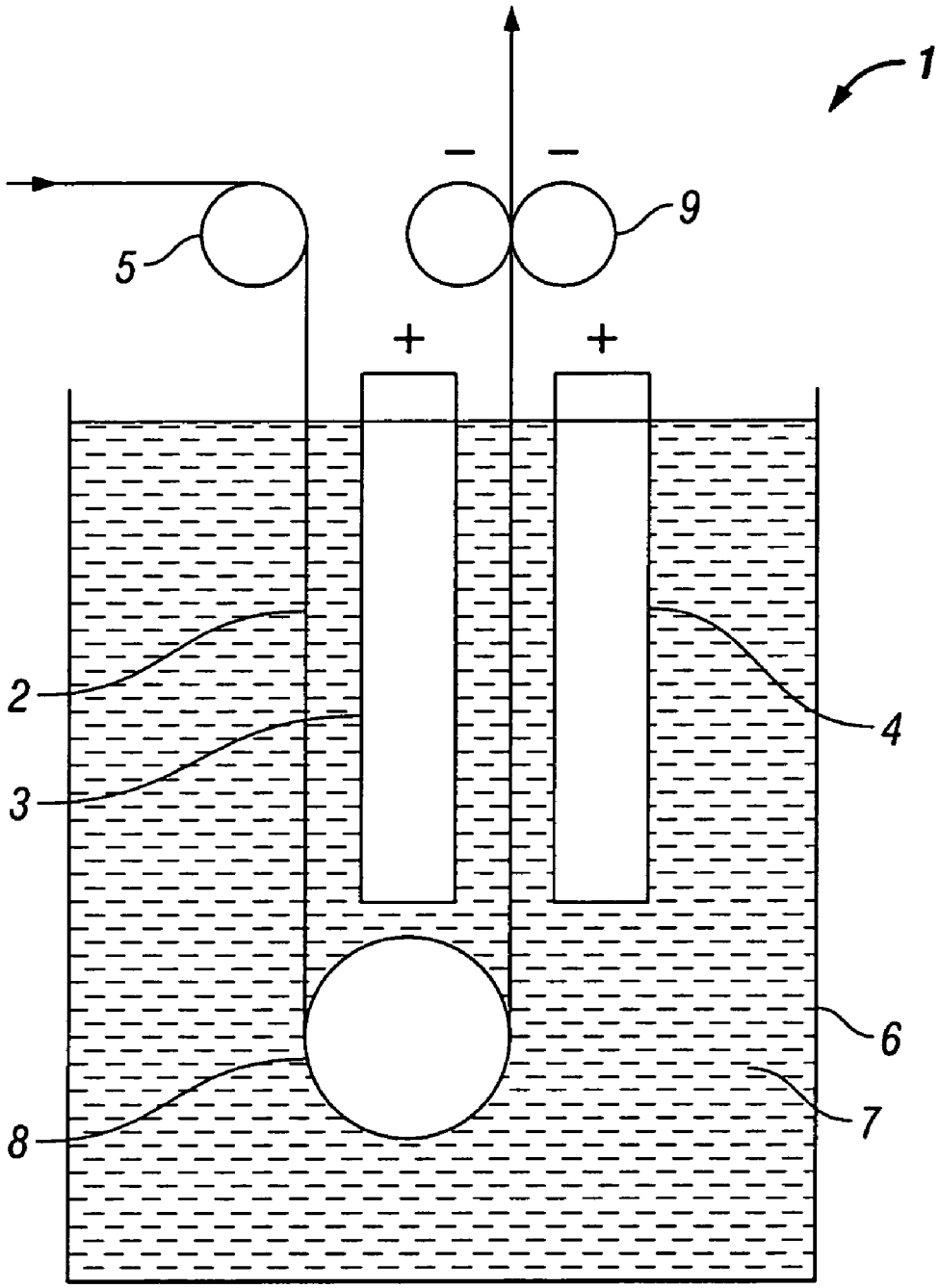
FIG. 1 (Prior Art)
FIG. 1 is a schematic depiction of a continuous vertical foam plater apparatus in accordance with the prior art.

In another aspect, an inclined foam plating system optionally incorporates techniques for redistributing current density from the top of the plating zone to areas below. In this manner, local excess current densities are avoided and a more uniform product is obtained. Foams plated at high current densities tend to have a non-uniform thickness profile, e.g., a high DTR. In a typical vertical foam plater, e.g., see FIG. 1, the energy to the deeper parts of the foam is supplied through the partially plated foam, whose density and conductivity decreases from top to bottom. Thus, energy supply to the deepest zones of the plater is restricted by the poor conductivity of the foam. Accordingly, the deep zones operate at low current densities and contribute little to the overall production rate. The top-plating zone(s) actually receives the highest current density and plates at the highest rate. The overall current density is therefore limited by the fact that the top zone(s) reaches a maximum safe plating rate before the lower zones, thus restricting further productivity increases even though the lower zones are capable of handling higher current densities.

Figure 4:
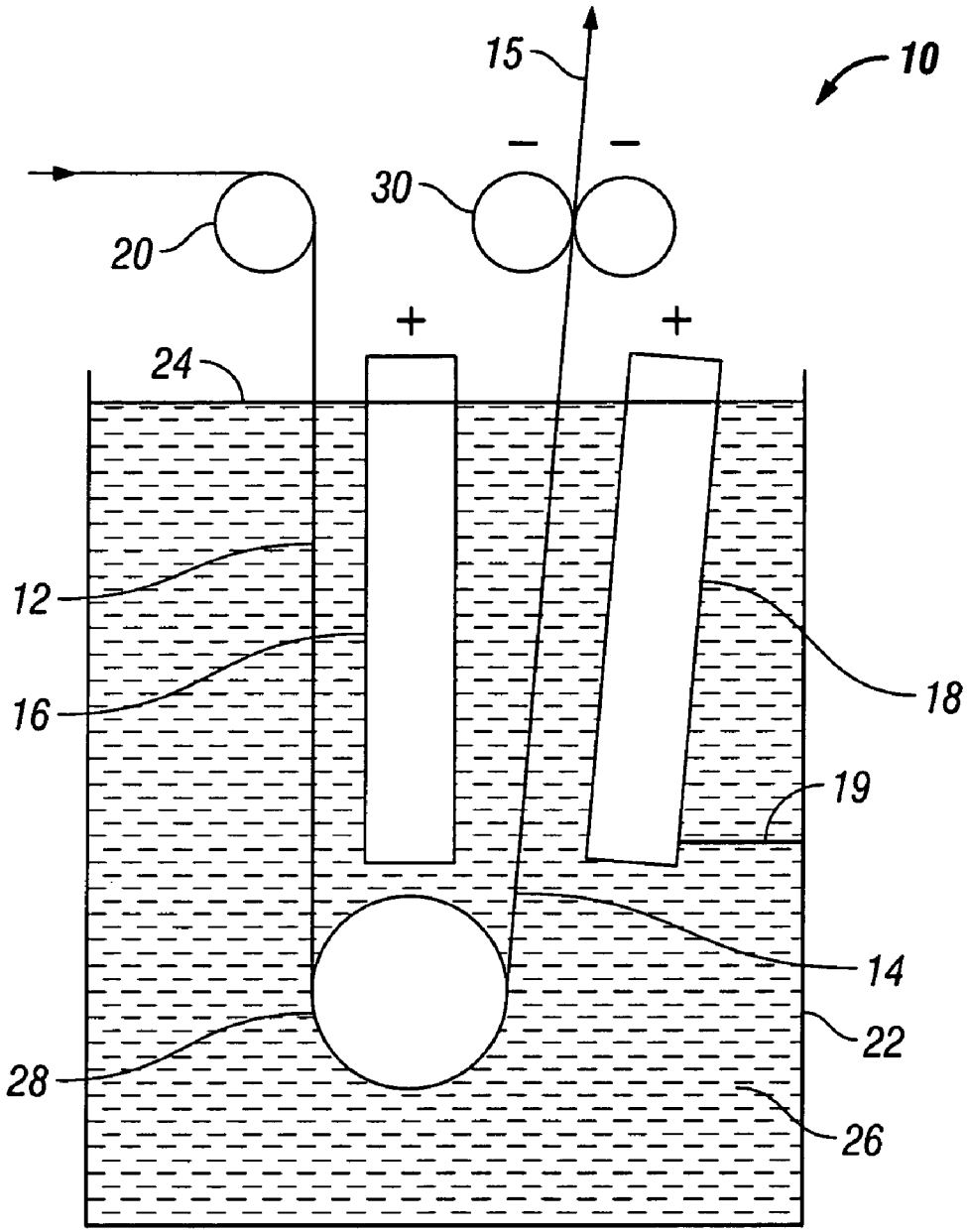
FIG. 4 is a schematic depiction of a continuous vertical foam plater apparatus incorporating a vertically oriented anode, an inclined foam cathode strip portion and an inclined anode.

In one embodiment, the electrolyte gap is increased at the top of the plater relative to the bottom. This produces a higher electrolyte voltage (IR) drop in the upper zone to reduce current density there while increasing current density in the lower zone with a narrower electrolyte gap and a smaller IR drop. The electrolyte gap is increased by increasing the distance between the cathode and the anode near and at the top of the plater relative to the bottom. The tapered electrolyte gap can be obtained by supporting one or more anodes in an inclined position relative to the cathode or by making one or more anodes wider at one end than at the other. FIG. 4 provides a schematic example of a continuing plater apparatus 10 for plating a continuous foam strip 12 incorporating an inclined foam cathode portion 14, a vertically oriented anode 16 and a further inclined anode 18. The inclined anode is supported by a support member 19. Anode 16 is held in place by another support member (not shown). The inclined foam cathode portion 14 is inclined at an intermediate angle, dividing the gap between the vertical anode 16 and the inclined anode 18. Those skilled in the art can determine optimum angles of incline which may be dependent, e.g., upon energy cost since the redistribution of current density involves an increase in voltage. Significant current redistribution can be achieved by an anode-to-anode gap varying from, e.g., about 5 cm at the bottom of the plating zone to between about 8-10 cm at the top. This results in a foam angle of between about 1-2 degrees when the vertical anode 16 is in fact vertical. Greater or lesser comparative angles of the foam relative to the anode(s) may be obtained by orienting the vertical anode 16 in a non-vertical configuration. Although a variable gap can be utilized to result in advantageous redistribution of current, it is also contemplated that, in certain embodiments, the anode(s) is oriented substantially parallel to the foam to create a uniform gap between the anode(s) and the foam. Indeed, anodes disposed on either side of the foam can be substantially parallel to each other and the foam, thus creating a uniform gap between the anodes and the foam. As used herein, "substantially" is intended to mean both "precisely" and "nearly." In another embodiment, depicted schematically in FIG. 5, a continuing plater apparatus 100 for plating a continuous foam strip 102 incorporating an inclined foam cathode portion 104, a vertically oriented anode 106 and a tapered anode 108. The orientation of the tapered anode 108 creates an increased gap at the top of the plating zone. Alternatively, both anodes can be tapered.

Figure 6:
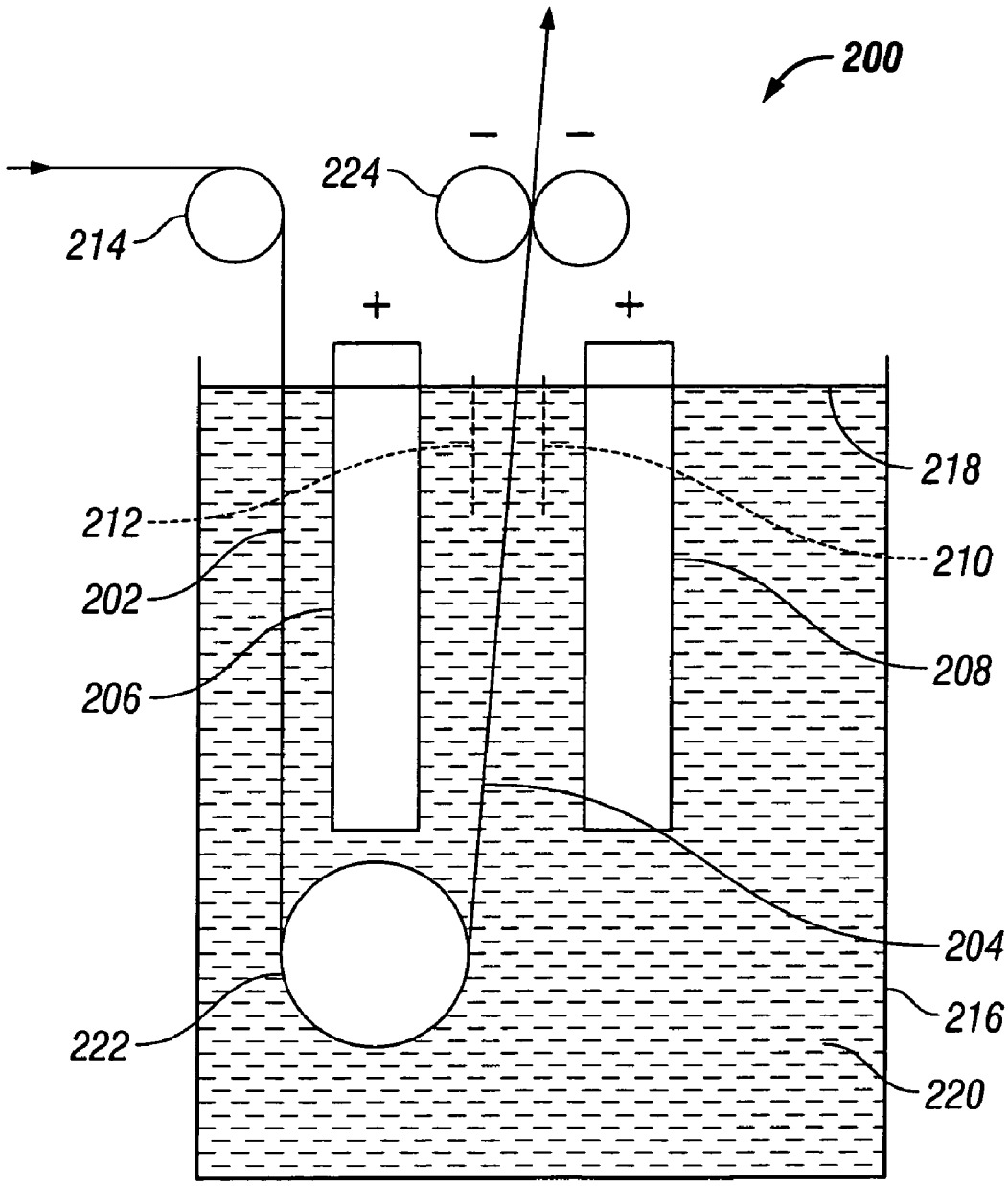
FIG. 6 is a schematic depiction of a continuous vertical foam plater apparatus incorporating an inclined foam cathode strip portion interposed between two vertically oriented anodes, and further interposed between two current reducing masks.

In another embodiment for increasing electrolyte resistance at the top of the plater where current is supplied, a current reducing mask is positioned between a foam cathode and the anode(s) in the top plating zone of a plater. The mask is preferably a non-conductive porous sheet which permits electrolyte to pass through, but slows the rate of plating. FIG. 6 schematically illustrates an example of a continuing plater apparatus 200 for plating a continuous foam strip 202 incorporating an inclined foam cathode portion 204, a first vertically oriented anode 206, a second vertically oriented anode 208, a first current reducing mask 210, and optionally, a second current reducing mask 212. The current reducing mask may be made of any suitable material, e.g., a natural material such as cellulosic fiber or asbestos fiber, or a polymeric synthetic material such as a polyolefin, polyester, polytetrafluoroethylene, polystyrene, polyvinylchloride, polyamide and the like. The mask may be in the form of a mesh, perforated sheet, woven fabric or nonwoven fabric. Techniques for fashioning such natural materials and synthetic polymers into mesh or fibers for woven and non-woven fabrics are well known. The electrical current forced through the restricted cross-section of the mask will produce higher IR drop in the upper zone(s) and force more current to the lower zone(s). In a preferred embodiment, the current reducing mask spans less than about 75% of the length of the anode.

Suitable open cell foams for use herein are well known. Those which may be employed include any natural or synthetic polymeric foams such as cellulose, hydroxypropyl cellulose, polyurethanes, including a polyether-polyurethane foam or a polyester polyurethane foam; polyesters, olefin polymers, such as a polypropylene or polyethlyene; vinyl and styrene polymers, polyphenol, polyvinyl chloride and polyamides. These foam substrates may have an average number of pores per inch within a wide range, typically within a range of about 5 to about 100 pores per inch (ppi.). In preferred embodiments the natural or synthetic foam is capable of being vaporized after deposition of the desired metal so that only metal is left at the end of production. In order to electroplate the foam, it must be made at least partially electrically conductive. The foam can be made conductive by any technique known to those skilled in the art, e.g., coating with a latex graphite; electroless plating with a metal such as copper or nickel; coating with an electrically conductive paint or ink containing carbon powder, or a metal powder such as silver powder or copper powder; and vacuum deposition of a metal. It will be understood that non-foam materials may also be employed as substrate materials. Filaments, including fibers or threads, may also serve as a substrate for the deposition of an electroconductive metal. The foam starting material can, however, also be formed from organic materials having electrical conductivity or consist of metal fibers. In the last-mentioned cases the application of an electrically conducting surface layer is not necessary and can be dispensed with. For convenience, all the above materials described in this paragraph will be referred to herein as "foam".

In general, and by way of example, a plating apparatus for use in accordance with the present disclosure may include a plating tank provided with a means of supply and removal of electrolyte bath; guides to guide pre-plated continuous foam down into the tank and then upward between anodes, e.g., baskets, towards the electrical contacts; a device for transporting foam located above the bath; a device(s) for supplying electrical current to the anode(s) and foam contacts; wherein the foam moving past the anode (or between 2 or more anodes) is inclined from vertical to allow depleted, lower density electrolyte inside the foam to rise and establish a natural convection driven diagonal flow of electrolyte through the foam. In a preferred embodiment, the anodes are positioned around the foam strip to substantially equalize current density distribution as described above, e.g., the electrolyte (foam to anode) gap increases from bottom zone to the top zone or through utilization of a current density reducing mask. In another preferred embodiment, the anodes are positioned such that the gap between the anode facing the upper face of the foam is smaller than the gap relative to the anode facing the lower side of the foam. This increases current density at the upper face of the foam where the electrolyte is more depleted and current efficiency is reduced.

Referring to the example shown in FIG. 4, the strip of conductive foam 12 is fed around a feed roll 20 into an electroplating tank 22. The tank 22 is maintained to a level 24 with a standard electroplating bath 26. The electroplating bath 26 can be any of a number of conventional electroplating baths capable of electroplating a variety of metals. Such metals include, by way of example, nickel, chromium, zinc, copper, tin, lead, iron, gold, silver, platinum, palladium, rhodium, aluminum, cadmium, cobalt, indium, mercury, vanadium, thalium, and gallium. Alloys can be plated in accordance with the present invention, such as brass, bronze, cobalt-nickel alloys, copper-zinc alloys and others. Some metals are not susceptible to electrodeposition from an aqueous medium and require special plating baths. For example, aluminum and germanium are most commonly electrodeposited from an organic bath or a medium of fused salt. All such known electroplating baths are conventional in the art and can be used herein.

The strip of conductive foam 12 is directed into the bath 26 downwardly and makes a turn around a lower immersed idler roll 28. The idler roll 28 may be made of any material inert to the electroplate bath, e.g., plastic. Suitable plastic materials include nylon, polyvinyl chloride, polyethylene and polypropylene. The strip 12 then travels upward from the idler roll 28 to a metal cathode pinch-roller assembly 30, electrically connected to a power source, e.g., by means of a conventional slip ring (not shown). The anodes 16, 18 can be consumable or non-consumable. The cathode foam portion 14 of the strip 12 is passed between the anodes at an angle described above to provide diagonal convection through the cathode foam portion 14. Thus, the cathode foam portion 14 of the strip 12 is plated on both sides and exits the container 22 as plated foam 15. It should be understood that in alternative embodiments, only one anode may be present which would tend to limit plating to one side of the strip 12. In other alternative embodiments, the anodes are maintained at uneven distances from the anode, e.g., closer to one side of the foam than the other, to cause a thicker plated coat on the side of the foam closest to the anode. In this manner, foam strips can be produced that are made to easily coil in the direction of the more lightly plated side.

Figure 5:
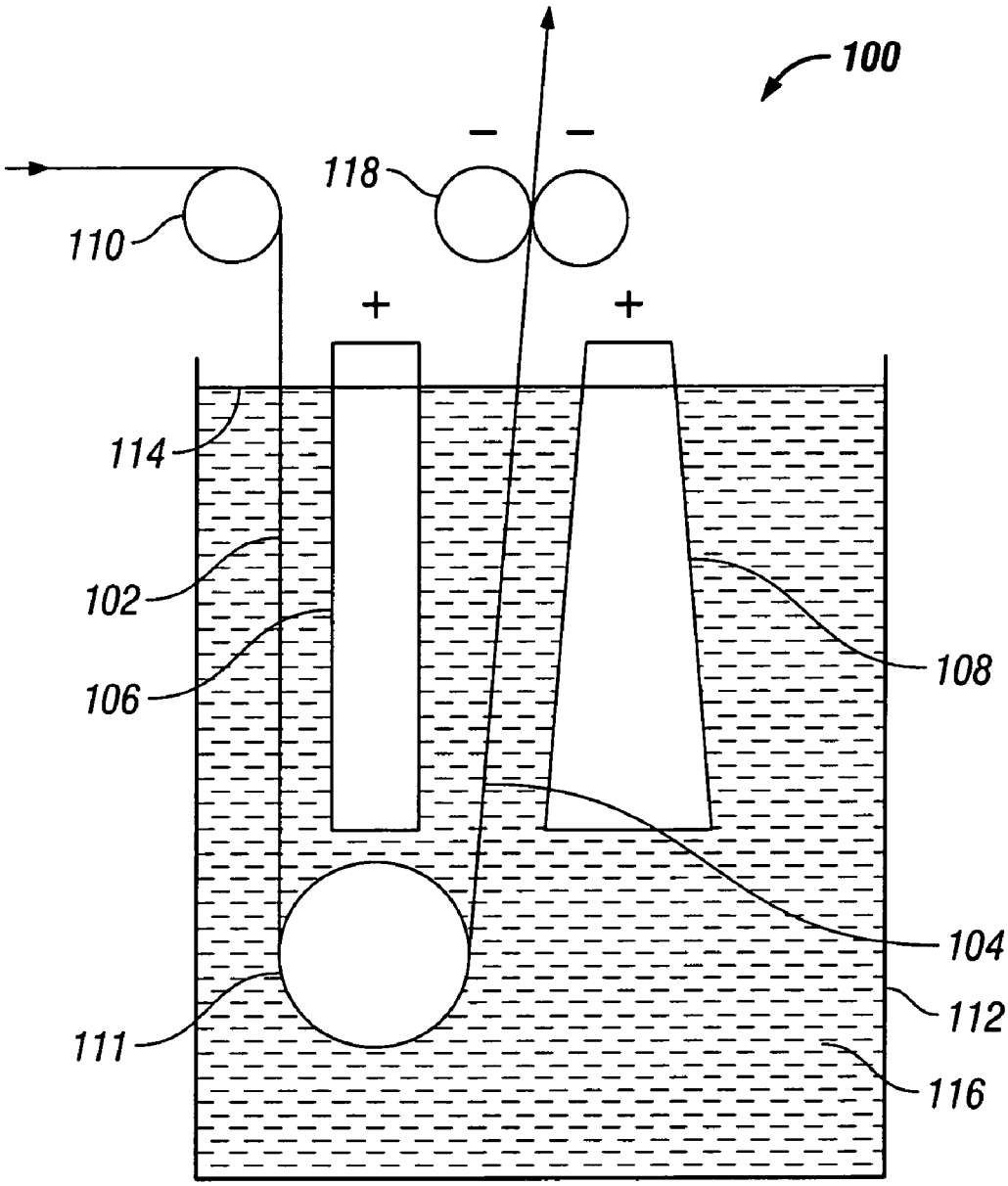
FIG. 5 is a schematic depiction of a continuous vertical foam plater apparatus incorporating a vertically oriented anode, an inclined foam cathode strip portion, and a tapered anode having a triangular longitudinal cross-section.

Referring to the example shown in FIG. 5, the strip of conductive foam 102 is fed around a feed roll 110 into an electroplating tank 112. The tank 112 is maintained to a level 114 with a standard electroplating bath 116. The vertical anode 106 is an essentially rectangular member which can be a basket made of titanium or other valve metal so that it is resistant to corrosion in the electroplating bath. Examples of other valve metals are tantalum, zirconium, niobium, tungsten, and alloys thereof wherein the alloy consists predominantly of at least one of the valve metals. The size of the basket of anode 106 is optimized for a given application. The width of the basket portion facing the inclined cathode foam portion 104 is preferably about the same as the width of the strip 102 of foam being plated. The depth of the basket can be made relational to the current density desired. The tapered anode 108 has a triangular longitudinal cross-section and may also be a basket which is resistant to corrosion. The gap between the cathode foam portion 104 and each of the anode baskets 106 and 108 increases toward the top of the plater.

The strip 102 of conductive foam is directed into the bath 116 downwardly and makes a turn around a lower immersed idler roll 111. The foam cathode portion of the strip 104 then travels upward from the idler roll 111 to a metal cathode pinch-roller assembly 118, electrically connected to a power source, e.g., by means of a conventional slip ring (not shown). As above, the anodes 106 and 108 can be consumable or non-consumable. The cathode foam portion 104 of the strip 102 is passed between the anodes at an angle described above to provide diagonal convection through the portion 104.

Referring to the example shown in FIG. 6, the strip 202 of conductive foam is fed around a feed roll 214 into an electroplating tank 216. The tank 216 is maintained to a level 218 with a standard electroplating bath 220. As above, the electroplating bath 220 can be any of a number of conventional electroplating baths capable of electroplating a variety of metals. The current reducing masks 210 and 212 are shown interposed, respectively between anodes 208 and 206. The strip 202 of conductive foam is directed into the bath 220 downward and makes a turn around a lower immersed idler roll 222. The foam cathode portion of the strip 204 then travels upward from the idler roll 222 to a metal cathode pinch-roller assembly 224, electrically connected to a power source, e.g., by means of a conventional slip ring (not shown). As above, the anodes 206 and 208 can be consumable or non-consumable. The cathode foam portion 204 of the strip is passed between the anodes at an angle described above to provide diagonal convection through the cathode foam portion 204.

Where a preferred porous metal article is made and electroplating of an open-cell foam is involved, the plating is often nickel plating and the resulting porous nickel sheet may generally have a weight within the range, e.g., of from about 300 grams per square meter, up to about 5,000 grams per square meter, of a major face of the article. More typically, this will be a sheet weight within the range of from about 400 to about 2,000 grams per square meter. For very openly porous material, the nickel plating weight will generally be, e.g., between about 1,000 and about 2,000 grams per square meter of the article. In certain embodiments, the anode baskets, for use with the above-described bath, may be filled with consumable nickel chips (not shown).

If desired, the method can also be supplemented by a heat treatment step, following metal deposition, the purpose of which is to remove the polymeric foam substrate material internally present, for example by means of pyrolysis. For example, after the completion of the plating, the resulting metallized article can be washed, dried, and may be thermally treated, e.g., to decompose a polymer core substance. In some instances, the article may be annealed, such as in a reducing or inert atmosphere. Such treatments are well-known in the art. See, e.g., U.S. Pat. No. 4,978,431 the entire contents of which are hereby incorporated by reference. When metal is plated, thermal decomposition may be conducted at a temperature ranging, e.g., from about 500° C. to about 800° C. for up to about 3 hours depending on the plastic foam (polymer) used. Annealing can be carried out by any known methods. For example, in the case of nickel, it may be carried out, e.g., in a hydrogen atmosphere at a temperature ranging from about 800° C. to about 1200° C. for up to about 30 minutes. The heat treatment conditions can also be chosen such that sintering of the deposited metal takes place, so that the structure is even more mechanically strengthened.

In accordance with the provisions of the statute, there is illustrated and described herein specific embodiments of the invention. Various modifications may be made to the examples and embodiments set forth herein without departing from the scope and spirit of the invention which is defined by the appended claims. For example, numerous plating zones can be incorporated by adding additional anodes which are passed by an inclined foam cathode strip. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An apparatus for electroplating foam comprising:
a container,
an anode and
a cathode, wherein
the anode and the cathode are located within the container, the anode including at least one metal for plating the cathode, the cathode including a polymeric foam including an electrically conductive material, wherein a straight portion of a length of the cathode extending substantially adjacent to the anode is oriented at an angle greater than about 1 degree to about 45 degrees relative to vertical inside the container such that a diagonal convection route of the electrolyte through the foam is established during electroplating.

2. An apparatus for electroplating foam according to claim 1, wherein the cathode is a continuous foam strip which is fed into the container, routed past the anode and out of the container by one or more guides.

3. An apparatus for electroplating foam according to claim 1, further comprising a second anode wherein the foam is positioned between the first and second anodes.

4. An apparatus for electroplating foam according to claim 1, wherein the anode is oriented substantially vertically within the container.

5. An apparatus for electroplating foam according to claim 1, wherein the anode and cathode have respective ends where electrical current is applied, and the distance between the cathode and the anode is greater at the ends where electrical current is applied than at opposite ends where current is not applied.

6. An apparatus for electroplating foam according to claim 3, wherein the anodes and cathode have respective ends where electrical current is applied, and the distance between the cathode and at least one of the anodes is greater at the ends where electrical current is applied than at opposite ends where current is not applied.

7. An apparatus for electroplating foam according to claim 1, further comprising an electrolyte solution.

8. An apparatus for electroplating foam according to claim 7, wherein the electrolyte solution contains nickel.

9. An apparatus for electroplating foam according to claim 1, wherein the anode is a basket containing nickel.

10. An apparatus for electroplating foam according to claim 5, wherein the anode has a triangular profile.

11. An apparatus for electroplating foam according to claim 6, wherein the second anode is canted to create the greater distance.

12. An apparatus for electroplating foam according to claim 3, wherein the first anode is placed at a closer distance to the cathode than the second anode to increase current density at an upper face of the foam relative to a lower face of the foam.

13. An apparatus for electroplating foam according to claim 3, wherein the second anode is placed at a closer distance to the cathode than the first anode to increase current density at a lower face of the foam relative to an upper face of the foam.

14. An apparatus for electroplating foam according to claim 1, wherein the anode and cathode have respective ends where electrical current is applied, and a porous non-conducting barrier is positioned between the anode and the cathode for reducing current density between the anode and the cathode.

15. An apparatus for electroplating foam according to claim 14, wherein the barrier spans less than about 75% of the length of the anode.

16. The apparatus for electroplating foam of claim 1, wherein the anode and cathode are substantially parallel.

17. The apparatus for electroplating foam of claim 1, wherein the angle of the cathode results in a substantially laminar flow of the electrolyte across the foam.

* * * * *